US005460444A

United States Patent [19]

Howorka

[11] Patent Number: 5,460,444

[45] Date of Patent: Oct. 24, 1995

[54] APPARATUS FOR THE TREATMENT OF SOLID, LIQUID AND/OR GASEOUS MATERIALS

[76] Inventor: Franz Howorka, Vienna, Austria

[21] Appl. No.: 229,330

[22] Filed: Apr. 18, 1994

[30] Foreign Application Priority Data

| | | | |
|---|---|---|---|
| Apr. 28, 1993 | [AT] | Austria | 822/93 |
| Apr. 28, 1993 | [AT] | Austria | 823/93 |
| Apr. 28, 1993 | [AT] | Austria | 824/93 |

[51] Int. Cl.[6] ..... B28C 5/12; B01F 7/26

[52] U.S. Cl. ..... 366/3; 366/103; 366/296; 366/317

[58] Field of Search ..... 366/293, 294, 366/295, 296, 315, 317, 316, 1, 2, 3, 5, 6, 11, 13, 64, 65, 66, 101, 102, 103, 104, 262, 265, 317

[56] References Cited

U.S. PATENT DOCUMENTS

| | | | |
|---|---|---|---|
| 3,044,685 | 7/1962 | Lapiken . | |
| 3,331,905 | 7/1967 | Hint . | |
| 3,823,919 | 7/1974 | Benedikter | 366/293 |

FOREIGN PATENT DOCUMENTS

| | | |
|---|---|---|
| 0048012 | 3/1982 | European Pat. Off. . |
| 3220328 | 8/1983 | Germany . |
| 3332209 | 3/1985 | Germany . |
| 1101981 | 2/1968 | United Kingdom . |

*Primary Examiner*—Robert W. Jenkins
*Attorney, Agent, or Firm*—Collard & Roe

[57] ABSTRACT

The invention relates to an apparatus for treating solid, liquid and/or gaseous materials with an activator with at least three coaxially arranged paddle rows (3, 4, 5) which are drivable in a contrarotating manner with beater paddles (6) having set angles of incidence (6), with the circumferential speed of the outer paddle rows (3, 4, 5) being between 70 m per sec. and 160 m per sec. In order to increase the extent of the achievable activation of the particles of the material and thus the performance of the apparatus and the quality of the manufactured products it is provided that the width ($b_1$, $b_2$, $b_3$) of the paddle rows (3, 4, 5) decreases outwardly by at least 2%, preferably by at least 5% and maximally by not more than 10%.

20 Claims, 3 Drawing Sheets

APPARATUS FOR THE TREATMENT OF SOLID, LIQUID AND/OR GASEOUS MATERIALS

The invention relates to an apparatus for the treatment of solid liquid and/or gaseous materials with an activator with at least three rows of paddles arranged coaxially and oppositely drivable with beater paddles having set angles of incidence, with the circumferential speed of the outermost rows of paddles being between 70 m per sec. and 160 m per sec., as well as methods for the activation of materials by using said apparatus.

Such an apparatus is known from GB-PS 1 101 981 and is used there for manufacturing hardenable masses, in particular building materials such as concrete, mortar and the like, whereby binding agents, additives and a liquid, preferably water, are introduced either simultaneously or as a mixture into the activator with the coaxially arranged contrarotating rows of paddles, the particles of the material are moved in the activator from the inside to the outside and are activated with increasing amplitude during the crossing of the rotating outer rows of the paddle. A wide row of paddles is arranged between two narrow rows of paddles, which leads to the consequence that the activation frequency varies for a particle travelling outwardly from the centre. The beater paddles thus used have a circular, triangular or rectangular cross section and are provided with the disadvantage that, particularly when strongly erosive media are used, they are subject to high wear and tear, as high relative speeds of more than 200 m per sec. occur between the paddle surface and the moving particles. At such high speeds it is not possible that a protective layer is formed between the paddle surface and the particles ejected onto the beater paddle.

Hardenable masses of the kind mentioned above usually consist of a binding agent, additives and a liquid, usually water. In the case of concrete the binding agent usually concerns cement. Sand is usually used as additive, which may, however, be replaced in part or in full by substite materials such as ground rubble.

From U.S. Pat. No. 3,331,905 a method is known for treating granular material with which building components of increased solidity are produceable. The initial materials thus used are activated in a desintegrator, thus leading to a change of the grain size spectrum and the specific surface of the particles. In this objection it is shown that this process of activation in the desintegrator increases the solidity of concrete or the like thus produced when compared with the solidity of concrete which was produced from non-activated material.

Furthermore, from EP-A 48 012 a desintegrator is known which can be used for the production of concrete. By using this known desintegrator it is possible to reduce the proportion of cement in the concrete whilst maintaining the same solidity.

In many fields of technology it is desirable to manufacture multiphase media which show low sedimentation effects or a low tendency towards separation. In a mixture of two non-soluble liquids, i.e., emulsions or liquids with non-soluble solid particles, there occurs in the course of time a separation of the components owing to the differing density.

In many cases this is undesirable, as is the case in coal slurries, for example, which are suspensions of coal dust in water and/or oil. Such slurries, however, would be highly suitable for conveying coal in pipelines. The sedimention effects as mentioned above, however, prevent a permanent availability of such mixtures with sufficiently high coal contents.

In particular during the cleaning of exhaust gases it is necessary to separate pollutants which are present in a gas in small quantities. During the desulphurization of flue gases spray columns are used, for example, in which the gas to be cleaned is guided through a mist of water which may be provided with certain additives such as lime, for example. To achieve a sufficiently high probability of contact of each pollutant particle with the medium it is necessary to build relatively large systems in this design.

From DE-A-33 32 209 a gas purification method is known in which the gas is subjected to a cleaning liquid in a spray column in the known manner. The washing liquid is treated prior to this in a desintegrator. This treatment provides an increased reaction of the cleaning agent which is caused by the activation in the desintegrator.

Furthermore, from DE-A 32 20 328 a desintegrator gas washer is known, in which the gases are subjected to a mechanical treatment simultaneously with a washing liquid. The desintegrator is arranged in accordance with the rotor-stator principle, i.e., static rows of paddles alternate with rotating rows of paddles.

Irrespective of the aggregate condition of the medium to be treated, be it gaseous, liquid or solid, the performance of the apparatus as well as the quality of the product produced by the apparatus depend on the extent of achievable activation of the particles of the material.

It is the object of the present invention to increase the extent of the achievable activation of the particles and thus the performance of the apparatus without decreasing the service life of the apparatus.

This is achieved in accordance with the invention in that the width of the rows of paddles decreases outwardly by at least 2%, preferably by at least 5% and maximally by 10 %. In this way the particles of the medium are stimulated during the crossing of the rows of paddles not only with rising amplitude, but also with increasing frequency.

In a surprising manner it was noticed that the stability of the activated medium can be increased substantially when the width of the rows of paddles is reduced outwardly to the said relatively low extent.

The relative speed of two adjacent rows of paddles rises continuously towards the outside. This is an obvious fact which follows from the outwardly increasing diameter of the rows of paddles. If one regards the path of a particle through the activator as an oscillation, the amplitude will rise continuously, which is caused by said geometrical conditions. If, however, the rows of paddles become outwardly narrower, as is proposed within the terms of the invention, a rising increase of the frequency is noticeable. This enables a far higher and more intense activation of the particles than could be achieved by pure increase of amplitude. In solid matters this effect should have a particular influence on the grain size distribution of the material. It is also the case that the geometrical shape of the particles and the specific surface are influenced in this way.

Trials have shown that not only the treatment of solid media, but also of liquid and gaseous media allow achieving a far higher activation of the particles. Thus it has been seen that the stability of emulsions or suspensions and thus their storage capabilities can be improved substantially. If the apparatus improved in accordance with the invention is used for the treatment of gases, in particular for cleaning flue gases, it is possible to achieve a far higher separation performance.

In the activator the individual particles are thrown with speeds of more than 200 m per sec. against the paddles and, in particular, against one another and are thus subjected to strong impacts. In-depth examinations have shown that the individual particles are subjected to between three and ten impacts. Owing to these impacts solid media are subjected to defects in the crystal lattice and macroscopic defects in addition to a comminution of the grains, which lead to an increase of the surface. Furthermore, an improved binding of the liquid and solid components of the mixture is achieved.

The decrease in the width of rows of paddles in turbo compressors is known per se, as is shown in U.S. Pat. No. 3,044,685. There, however, the width of the rows of paddles decreases far more than is provided in accordance with the invention for the activation of media. The decrease of the width of the paddle row in the outward direction is provided in the compressor shown in the objection for forming high-pressure stages and does not play any role in the activation of materials.

In a preferred embodiment of the invention it is provided that the beater paddles are arranged in a concave form and consist preferably of at least two plates substantially plane and angular with respect to one another. Owing to the concave form the medium comes to sit close on the paddles during the operation. This bearing is continuously renewed by the impingement of particles and extensively protects the paddles automatically from erosion and wear and tear.

Owing to the fact that the outer edges of the beater paddles showing towards the axis of rotation are provided with protective strips, it is possible to considerably increase the service life of the apparatus in addition.

An improved radial transport of material is achieved in that a ventilator paddle each is arranged between two adjacent beater paddles of the outermost row of paddles. Furthermore it is preferable when a ventilator paddle is adjacent at the outer end of each beater paddle of the outermost row of paddles on the side lying in the direction of rotation of the rotor, preferably at a right angle to the beater paddle.

If the apparatus is used for producing hardenable masses, in particular building materials such as concrete, mortar and the like, it is preferable for achieving a high activation of the material when the speed of the paddle rows is between 800 and 3000 l/min.

The speed of the paddle rows, however, should lie between 950 and 2800 l/min when multiphase stable media such as emulsions or suspensions are produced.

For the treatment of gases, in particular for the absorption of pollutants, the speed of the paddle rows may lie between 900 and 3500 l/min.

The above mentioned method for producing hardenable masses, in particular of building materials such as concrete, mortar and the like, whereby binding agents, additives and a liquid, preferably water, are introduced simultaneously or as a mixture into the activator with coaxially arranged contrarotating paddle rows, the particles of the material are moved in the activator from the inside to the outside and are stimulated with increasing amplitude whilst crossing the outer paddle rows rotating at a circumferential speed of between 70 and 160 m per sec., is further developed in accordance with the invention in that the particles of the material are stimulated with increasing frequency during the crossing of the paddle rows which decrease outwardly by at least 2%, preferably by at least 5% and maximally not more than 10%.

The use of binding agents such as cement, lime or water glass and the additives of sand, loess, rubble or filter ash in particular allow achieving an excellent activation of the material improved in accordance with the invention and thus a high production performance and quality. The solidity of the masses can be increased considerably as compared with the known methods when maintaining the same conditions in all other respects such as formula, etc. without deteriorating the service life.

By using the apparatus in accordance with the invention a method is further proposed for manufacturing multiphase stable media such as emulsions or suspensions within the scope of the present invention, in which the individual components are introduced in accordance with the desired mass ratio simultaneously or as a mixture into the activator with coaxially arranged contrarotating paddle rows, the particles of the material are moved in the activator from the inside to the outside, they are stimulated with rising amplitude and rising frequency whilst crossing the outer paddle rows rotating with a circumferential speed of between 70 and 160 m per sec. and decreasing outwardly by at least 2%, preferably by at least 5% and maximally by not more than 10%.

This method in accordance with the invention has proved its value in particular in the production of coal dust suspensions, in which water and/or oil as well as coal dust are used as starting materials. Owing to the invention it is possible to produce such suspensions with high solid contents which are stable over long periods of time.

For the treatment of gases, in particular for the absorption of pollutants by means of the apparatus in accordance with the invention it is provided that a liquid or dust-like medium is injected into the gas to be treated, the gas including the medium is introduced into the activator with coaxially arranged contrarotating paddle rows, the medium is moved in the activator from the inside to the outside and and it is stimulated with rising amplitude and rising frequency whilst crossing the paddle rows rotating with a circumferential speed of between 70 and 160 m per sec. and decreasing outwardly by at least 2%, preferably by at least 5% and maximally by not more than 10% and the medium is separated from the gas.

This method in accordance with the invention is suitable for various cleaning processes. Thus, a liquid medium such as water or milk of lime can be injected into the gas before the introduction of the gas into the activator. It is, however, also possible to inject such a medium directly into the activator.

The invention also comprises processes which are carried out in a dry manner such as, for example, the object of finely ground dolomite.

Finally, one or several solid materials can be added to a liquid medium.

In a preferred embodiment of the method in accordance with the invention one or a plurality of solid materials are added to the cleaning medium before the injection. On entering the activator said solid materials can be present in dissolved form or as suspended particles. If the cleaning of the gas concerns a desulphurization process, as is frequently required with respect to flue gases, lime, dolomite or the like is added to the water acting as carrier medium. In addition to the intimate mixture of all components in the activator, also an activation and thus a near complete reaction occurs there.

This method is characterized by a particularly high separation performance.

Owing to the rotary pump-like conveying effect of the activator it is possible to omit the use of suction draught ventilators in power plants.

Below, the invention is explained in closer detail by reference to the embodiments shown in the drawings, in which FIG. 1 shows schematically an activator in accordance with the invention in a partly sectional view;

Figure 2:
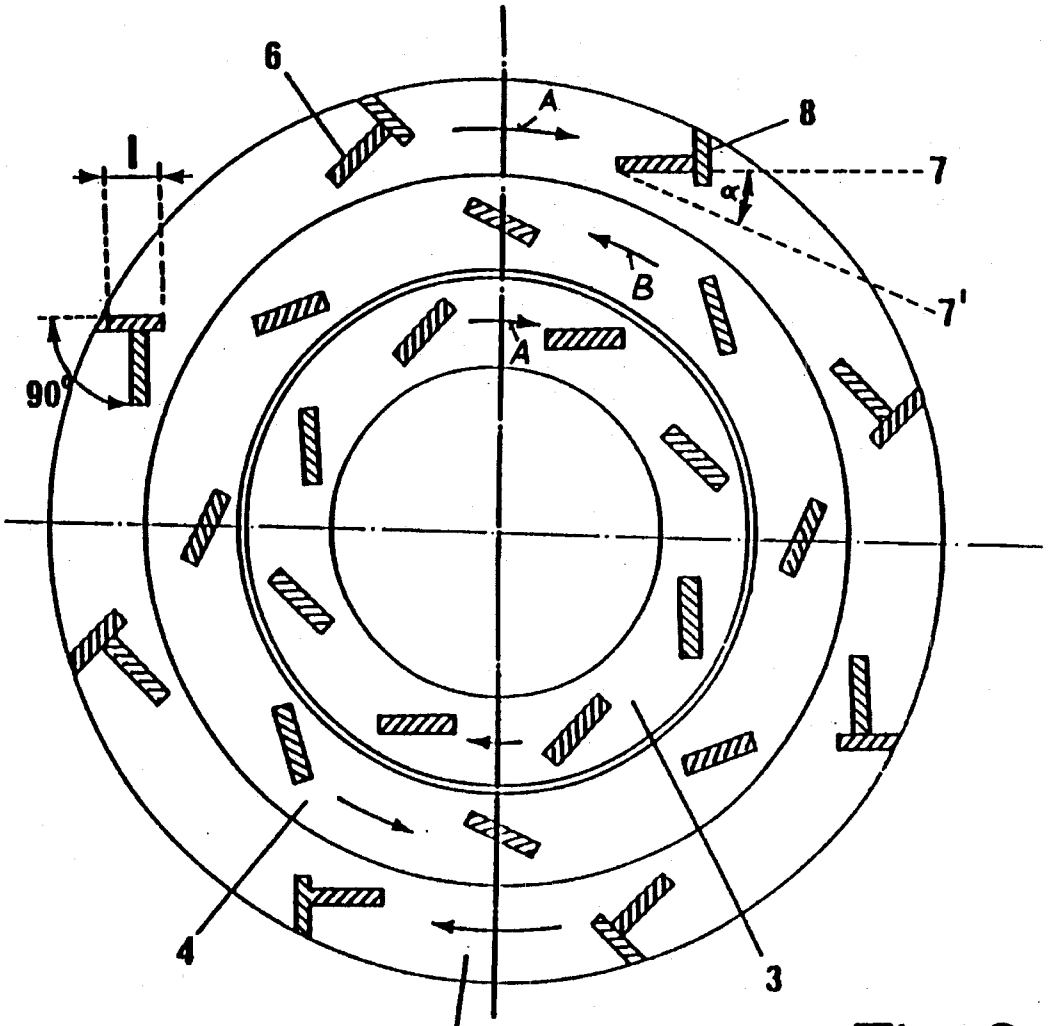
FIG. 2 shows schematically a section along line II/II of FIG. 1.
Figure 1:
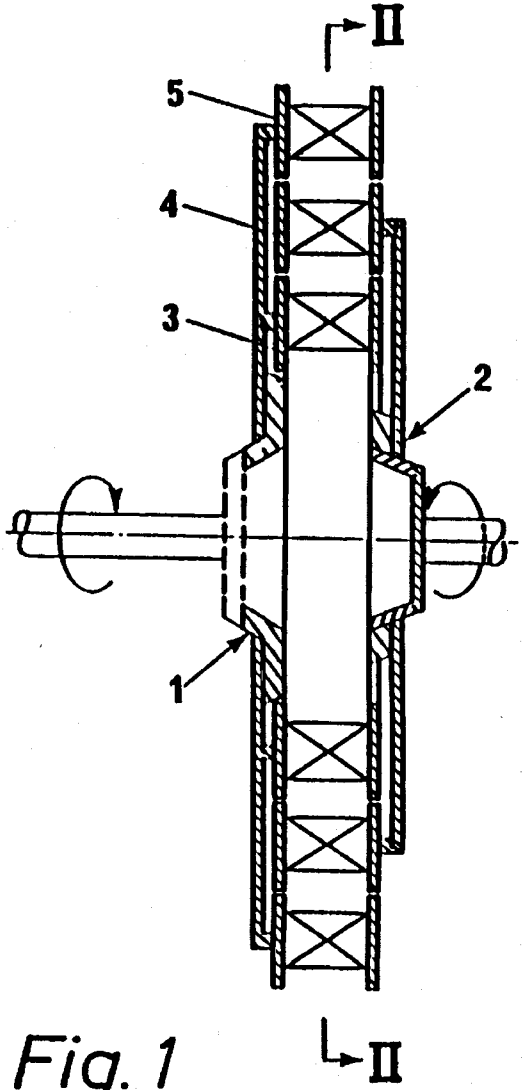

The activator shown in FIGS. 1 and 2 consists of two rotors 1 and 2 moved in opposite directions, whose directions of rotation are indicated with arrows A and B. For the sake of simplicity the casing with its central inlet and its outlet on the circumference has been omitted. The processing of the material to be treated is carried out by three paddle rings 3, 4, 5 of beater paddles 6. In the present case the outermost ring 5 and the innermost ring 3 of the beater paddles are carried by the rotor 1 and the intermediate ring 4 is carried by rotor 2. The beater paddles 6 of the outer ring 5 at least are concave, i.e., they are angular. The basic plane 7 of said beater paddles is set at an angle α, which is measured, as can be seen in FIG. 2, from a plane 7 extending from the entrance edge of the paddle in the circumferential direction to the tangential plane 7'.

Figure 3:
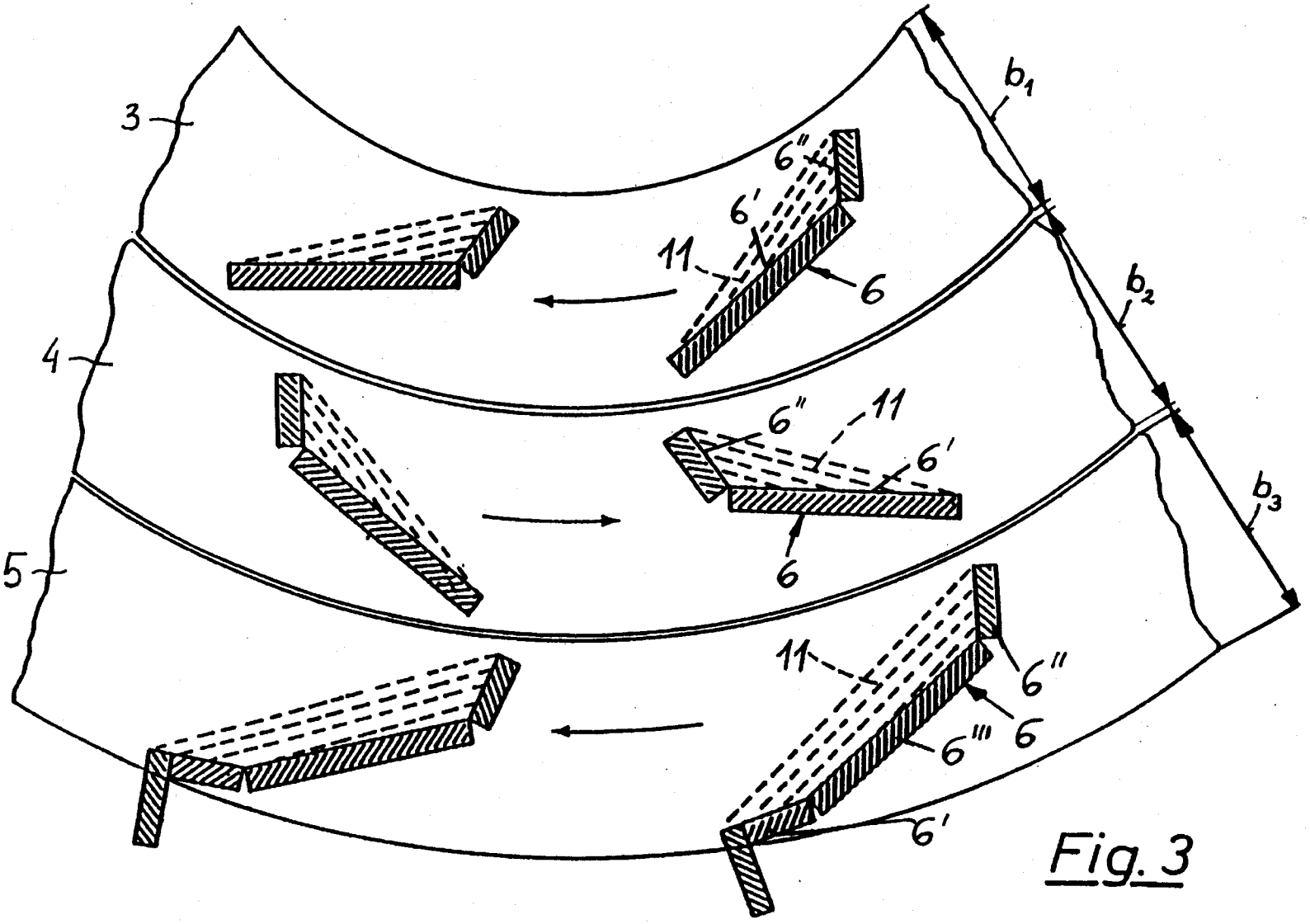
FIG. 3 shows schematically an embodiment of the paddle shape.

In the embodiment of the activator as shown in FIG. 3 the two inner rings 3 and 4 are provided with concave paddles 6 which consist of two substantially plane plates 6' and 6". The plates 6' which are at the front as seen in the direction of movement are longer and inclined less towards the tangential plane than the rear parts 6". Owing to the concave form the medium to be processed comes to sit close on paddles 6 during the operation. This bearing, which is indicated by reference numeral 11, is renewed continuously by the impingement of particles and protects the paddles 6 substantially automatically from erosion and wear and tear.

Figure 4:
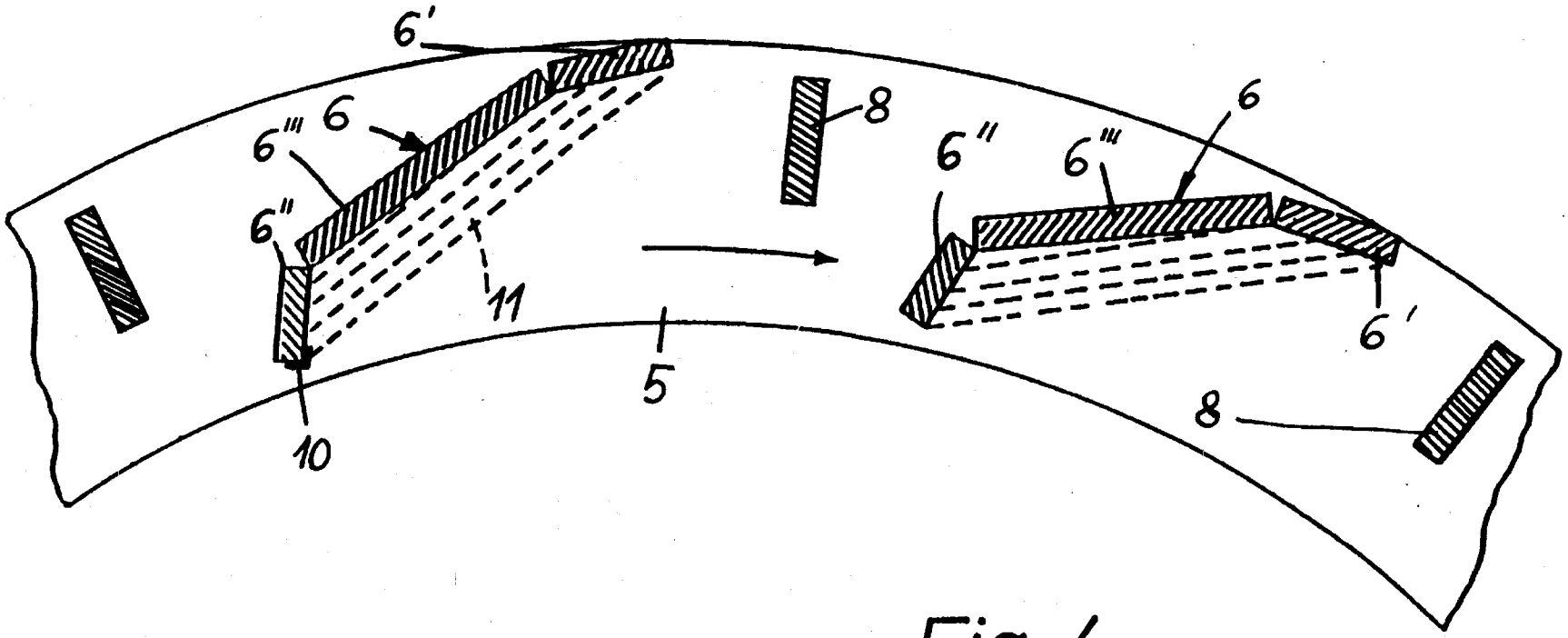
FIG. 4 shows schematically a further embodiment thereof.

In the angular form of the beater paddles as shown in FIG. 4 the angular part 6' and 6" is shorter than the remaining part 6''' and is usually half or less than the overall length of the beater paddles. The inclination of the shorter part 6' or 6" occurs from part 6''' towards the centre of the rotor. The angular end pieces 6', 6" may be provided at either end of part 6''' or only at one end thereof. In the present case they are preferably provided at the trailing end thereof. Preferably, they are made from solid metal or lined with it and can be attached exchangeably. However, it is also possible to manufacture them from ceramics or synthetic materials. Finally, there is also the possbility to line the outer edges of parts 6', 6" showing towards the rotor axis with protective strips 10.

Ventilator paddles 8 are provided between the beater paddles or the end of the beater paddles of the outermost ring 5 lying at the front during the rotation of rotor 1, which ventilator paddles may have any desired shape and which are arranged, for example, as plate, finger or the like. It is their object to secure the flow of the material to be treated from the inside to the outside and to form on the surface of the beater tools showing towards the rotor axis a protective layer made from the material to be treated, irrespective of the angle of incidence α. Said angle may lie below 15° for certain tasks, whereas it may be more preferable for it to be over that value for other tasks, 20° to 35° for example.

FIG. 3 shows schematically a section from three successive rings of the activator in accordance with the invention. It is important that the width $b_1$, $b_2$ and $b_3$ of the rings decreases outwardly continuously by at least 2–5%. The width should decrease maximally by 10%, i.e..:

$$0.9\ b_1 \leqq b_2 \leqq 0.98\ b_1$$

$$0.9\ b_2 \leqq b_3 \leqq 0.98\ b_2$$

I claim:

1. An apparatus for treating solid, liquid and gaseous materials, which comprises at least three concentrically arranged annular rows of beater paddles counterrotating about a common axis of rotation at a circumferential speed of 70 to 160 meters per second, the beater paddles having an impact surface enclosing a dihedral angle with respective tangential planes of the annular rows, and the annular rows of beater paddles having widths decreasing outwardly by 2% to 10%.

2. The apparatus of claim 1, wherein the widths of the annular rows of beater paddles decreases outwardly by at least 5%.

3. The apparatus of claim 1, wherein the impact surface of the beater paddles is concave.

4. The apparatus of claim 3, wherein the concave impact surface of the beater paddles comprises two plane portions enclosing an obtuse angle with each other.

5. The apparatus of claim 1, further comprising protective strips on outer edges of the beater paddles, the protective strips facing the axis of rotation.

6. The apparatus of claim 1, further comprising a ventilator paddle leading each one of the beater paddles in the direction of rotation of an outermost one of the rows of beater paddles, the ventilator paddles being arranged between adjacent ones of the beater paddles.

7. The apparatus of claim 6, wherein the ventilator paddles are arranged at a leading outer edge of each beater paddle in the operating direction.

8. The apparatus of claim 7, wherein the ventilator paddles extend perpendicularly to the beater paddles.

9. The apparatus of claim 1, wherein the speed of rotation of the rows of beater paddles is between 800 and 3000 rpm.

10. The apparatus of claim 1, wherein the speed of rotation of the rows of beater paddles is between 950 and 2800 rpm.

11. The apparatus of claim 1, wherein the speed of rotation of the rows of beater paddles is between 900 and 3500.

12. A method of treating particles of building materials, such as concrete, mortar and the like, to obtain a hardenable mass, which comprises introducing the building materials, together with particles of at least one binding agent and additive, and a liquid, in an apparatus comprising at least three concentrically arranged annular rows of beater paddles, counterrotating the annular rows of beater paddles about a common axis of rotation at a speed of rotation of 800 to 3000 rpm while moving the building materials, together with the binding agent, additive and liquid outwardly through the annular rows of beater paddles against impact surfaces of the beater paddles, the beater paddles enclosing a dihedral angle with respective tangential planes of the annular rows to activate the particles at a rising amplitude as they move through the annular rows of the beater paddles, and the annular rows of beater paddles having widths decreasing outwardly by 2% to 10% to activate the particles at a rising frequency.

13. The method of claim 12, wherein the liquid is water.

14. The method of claim 12, wherein the binding agent is selected from the group consisting of cement, lime and waterglass.

15. The method of claim 12, wherein the additive is selected from the groups consisting of sand, loess, rubble and filter ash.

16. A method of producing a multiphase liquid medium of immiscible components, such as an emulsion or a suspension, which comprises introducing the components at desired ratios in an apparatus comprising at least three concentrically arranged annular rows of beater paddles, counterrotating the annular rows of beater paddles about a common axis of rotation at a speed of rotation of 950 to 2800 rpm while moving the components outwardly through the annular rows of beater paddles against impact surfaces of the beater paddles, the beater paddles enclosing a dihedral angle with respective tangential planes of the annular rows to activate the components at a rising amplitude as they move through the annular rows of the beater paddles, and the annular rows of beater paddles having widths decreasing outwardly by 2% to 10% to activate the components at a rising frequency.

17. The method of claim 16, wherein the components comprise water and coal dust.

18. The method of claim 16, wherein the components comprise oil and coal dust.

19. A method of treating a gas, which comprises the steps of injecting an absorptive medium into the gas to be treated, introducing the gas and the medium in an apparatus comprising at least three concentrically arranged annular rows of beater paddles, counterrotating the annular rows of beater paddles about a common axis of rotation at a speed of rotation of 900 to 3500 rpm while moving the gas and medium outwardly through the annular rows of beater paddles against impact surfaces of the beater paddles, the beater paddles enclosing a dihedral angle with respective tangential planes of the annular rows to activate the gas and medium at a rising amplitude as they move through the annular rows of the beater paddles, and the annular rows of beater paddles having widths decreasing outwardly by 2% to 10% to activate the gas and medium at a rising frequency.

20. The method of claim 19, wherein the medium comprises a liquid and at least one pulverulent material.

* * * * *